US007430993B2

(12) United States Patent
Yasui

(10) Patent No.: US 7,430,993 B2
(45) Date of Patent: Oct. 7, 2008

(54) COOLING STRUCTURE OF ENGINE

(75) Inventor: Nobuhiro Yasui, Shizuoka (JP)

(73) Assignee: Suzuki Motor Corporation, Shizuoka, Hamamatsu-Shi (JP)

( * ) Notice: Subject to any disclaimer, the term of this patent is extended or adjusted under 35 U.S.C. 154(b) by 288 days.

(21) Appl. No.: 11/141,906

(22) Filed: May 31, 2005

(65) Prior Publication Data

US 2005/0263110 A1 Dec. 1, 2005

(30) Foreign Application Priority Data

Jun. 1, 2004 (JP) ..... 2004-163358

(51) Int. Cl.
*F02F 1/10* (2006.01)

(52) U.S. Cl. ..... 123/41.72; 123/41.44

(58) Field of Classification Search ..... 123/41.72, 123/41.44

See application file for complete search history.

(56) References Cited

U.S. PATENT DOCUMENTS

| | | | | |
|---|---|---|---|---|
| 4,190,023 | A * | 2/1980 | Fujikawa et al. | 123/41.72 |
| 4,393,822 | A | 7/1983 | Obermayer et al. | |
| 2001/0050193 | A1 * | 12/2001 | Yoshida et al. | 180/219 |

FOREIGN PATENT DOCUMENTS

| | | |
|---|---|---|
| DE | 3026041 | 3/1981 |
| DE | 10047080 | 4/2002 |

OTHER PUBLICATIONS

Patent Abstracts of Japan for 2-245423 A published on Oct. 1, 1990.
Patent Abstracts of Japan for 61-265343 A published on Nov. 25, 1986.
Abstract of Japanese Utility Model Application No. 4-27139 published on Mar. 4, 1992.

* cited by examiner

*Primary Examiner*—Stephen K. Cronin
*Assistant Examiner*—Katrina B Harris
(74) *Attorney, Agent, or Firm*—Darby & Darby P.C.

(57) ABSTRACT

A cooling water communication passage extending in a cylinder disposition direction is provided at a cylinder block-integrated crankcase of an engine with parallel multiple cylinders loaded by being tilted forward, and cooling water is supplied to a water jacket from the cooling water communication passage. The cooling water communication passage is adjacently disposed below the water jacket at a rear side of the cylinder bank, a water pump is placed at a crankcase side wall located at a rear side from a crankshaft, and a downstream side cooling water pipe through which the cooling water discharged from the water pump is passed is connected to an intermediate portion of the cooling water communication passage.

15 Claims, 7 Drawing Sheets

COOLING STRUCTURE OF ENGINE

CROSS-REFERENCE TO RELATED APPLICATIONS

This application is based upon and claims the benefit of priority from the prior Japanese Patent Application No. 2004-163358, filed on Jun. 1, 2004, the entire contents of which are incorporated herein by reference.

BACKGROUND OF THE INVENTION

1. Field of the Invention

The present invention relates to a cooling structure in a parallel multiple-cylinder engine especially having a cylinder-integrated crankcase of aluminum die-cast.

2. Description of the Related Art

Conventionally, in an engine having a water-cooling type cooling device as a cooling device of a four-cycle or two-cycle engine, cooling water is supplied to a water jacket formed to surround a cylinder by a water pump. On this occasion, various kinds of contrivance are made to enhance cooling performance, and decrease the size.

For example, in a V-type engine described in Japanese Patent Application Laid-open No. 2-245423, an extended part extending in the direction of a crankshaft is formed at an end surface of a cylinder body which is offset to the other end side in an axial direction of the crankshaft, a step part is formed between this extended part and the cylinder body, and a communication water passage which guides cooling water to a water pump is disposed at this step part.

In a cooling device described in Japanese Patent Application Laid-open No. 61-265343, a partition wall is provided in a water jacket, and a flow passage in a proper shape is formed in this partition wall.

Further, in a water-cooling type multi cylinder engine described in Japanese Utility Model Application Laid-open No. 4-27139, a main water passage passing in a cylinder arrangement direction below each water chamber is provided in a wall body of a cylinder block, and the main water passage and each of the water passages are made to communicate each other separately for each cylinder.

Incidentally, in a parallel multi-cylinder engine of this kind, there is an engine in which a crankcase is cast to be integral with a cylinder of aluminum die cast, with the cylinder made a plated cylinder, the cylinder has an angle from verticality with respect to the mating surface of the crankcase, and a water passage is included on a mating surface with the cylinder head.

In an engine of this type, the lower side of the water jacket at an intake side is undercut due to casting, and considerable useless thickness is included as it is. Since the cylinder surface slides with a piston relatively at a high speed, a casting cavity, a casting sink, a crack or the like which is the drawback of the die cast, becomes a fatal problem for an engine as it is. Useless thickness not only becomes the largest cause of such problems, but also becomes the cause of an increase in unnecessary weight as a matter of course.

Meanwhile, the water pump is usually driven by a countershaft or a crankshaft, and is located at a rear side from the cylinder axis. In this case, piping of a water passage to the cylinder has the shortest distance when connected to an intake side of the cylinder, and thereby, favorable pump efficiency can be obtained.

However, the lower side of the mounting surface of the water inlet also becomes undercut and has useless thickness due to casting, and therefore, the cylinder with the aforementioned structure is inconvenient.

As the conventional countermeasure, piping is arranged around the cylinder exhaust side, for example. In this case, however, the length of the passage becomes long, and not only the pump loss becomes large, but also a space for leading the piping to an outside of the cylinder or a lower part of the case becomes necessary. In the case with a faring, the width becomes wider correspondingly, which causes increase in air resistance, reduction in performance and fuel efficiency. In the case without a fairing, there is the possibility of breakage when falling down as it is.

In the case of an ordinary cylinder, with an even number of cylinders, it is not efficient in securing a passage to connect the passage by striding a boss for a cylinder head fastening screw between bores, and hence, the passage is actually connected at the side of either one of them. Therefore, cooling of each cylinder cannot be performed uniformly, thus causing a variation of the combustion condition, and hence, reduction in engine performance is caused.

SUMMARY OF THE INVENTION

The present invention is made in view of the above circumstances, and it is an object of the present invention to provide a cooling structure of an engine which solves the problem in especially manufacturing undercut or the like, and realizes excellent cooling performance.

A cooling structure of an engine of the present invention is characterized in that in an engine in which a cooling water communication passage extending in a cylinder bank direction is provided at a cylinder block-integrated crankcase of an engine with parallel multiple cylinders loaded by being tilted forward, and cooling water is supplied to a water jacket from the cooling water communication passage, the cooling water communication passage is adjacently disposed below the water jacket at a rear side of the cylinder bank, a water pump is placed at a side wall of the crankcase located at a rear side from a crankshaft, and a downstream side cooling water pipe through which the cooling water discharged from the water pump is passed is connected to an intermediate portion of the cooling water communication passage.

The cooling structure is characterized in that in the cooling structure of an engine of the present invention, the cooling water communication passage has a larger diameter than a sectional width of the water jacket, and a crankcase outer wall extending from a lower side of a boss part which forms the cooling water communication passage is offset from an extension line in a cylinder axis direction, of the water jacket in a cylinder axis direction.

The cooling structure is characterized in that in the cooling structure of an engine of the present invention, the water pump is provided at a side wall of a lower crankcase to which an oil pan is mounted, and is located at a lower rear position from the crankshaft, the water pump, a downstream side cooling water pipe connected to the water pump and an upstream side cooling water pipe connected in a substantially annular form to the water pump are arranged along a crankcase bottom wall around the crankshaft, and a connecting part of the downstream side cooling water pipe to the cooling water communication passage is disposed at an outer side in the crankshaft direction from the connecting part of the water pump.

The cooling structure is characterized in that in the cooling structure of an engine of the present invention, a lower end surface of the water jacket is set to be shorter than a piston stroke, and a position at which the cooling water communication passage is provided is set at a height which substantially overlays a piston position at a piston bottom dead center position.

The cooling structure is characterized in that in the cooling structure of an engine of the present invention, in an upper crankcase of the engine, between neighborhoods of the crankshaft and the countershaft, the cooling water communication passage portion and a breather chamber portion are provided in sequence from a front to face upper surfaces, with respective heights gradually lowered, and a starting motor is placed above the breather chamber.

DETAILED DESCRIPTION OF THE PREFERRED EMBODIMENTS

A preferred embodiment in a cooling structure of an engine according to the present invention will be explained based on the drawings hereinafter.

Figure 1:
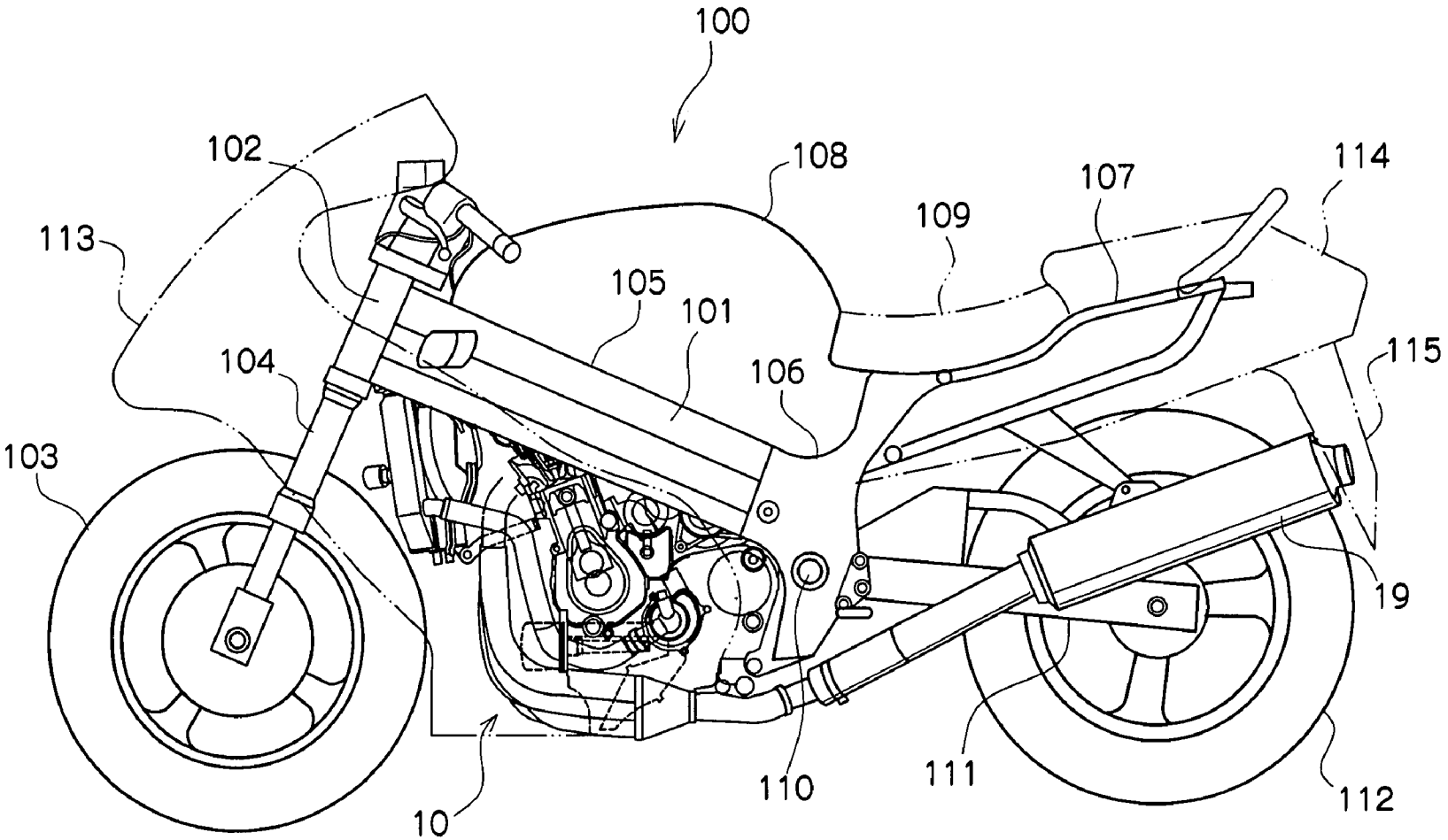
FIG. 1 is a side view of a motorcycle showing an application example of the present invention in an embodiment of the present invention.

FIG. 1 shows one example of a motorcycle to which the present invention is applied in this embodiment. Here, explaining a schematic construction of a motorcycle 100 first as shown in FIG. 1, the motorcycle 100 has a vehicle body frame 101, and a head pipe 102 is provided at a front thereof. The head pipe 102 is internally equipped with a suspension mechanism not shown, and is provided with a steering mechanism constructed by a set of left and right front forks 104 and the like which rotatably support a front wheel 103.

The body frame 101 is a twin tube type, for example, and includes a set of left and right tank rails 105 extending diagonally downward to the rear in parallel with each other after being expanded in a lateral direction immediately behind the head pipe 102, a set of left and right center frames 106 connected to rear end portions of the tank rails 105 and extending in a substantially up and down direction, and a set of left and right seat rails 107 extending rearward from rear upper ends of the center frames 106.

A fuel tank 108 is disposed above the tank rails 105, and a driver's seat 109 is disposed above the seat rail 107. A pivot shaft 110 is laid at a central lower portion of the center frame 106, and a swing arm 111 is pivotally attached around the pivot shaft 110 to be swingable. A rear wheel 112 is rotatably supported at a rear end of the swing arm 111.

A front part of a vehicle body of the motorcycle 100 is covered with a streamlined cowling 113 to achieve reduction in air resistance during traveling and protection of a rider from traveling wind pressure. A seat cowl 114 is attached around a driver's seat 109 at a rear part of the vehicle body to cover an area above the rear wheel 112, and a rear fender 115 is further provided at a rear part of the seat cowl 114.

Figure 2:
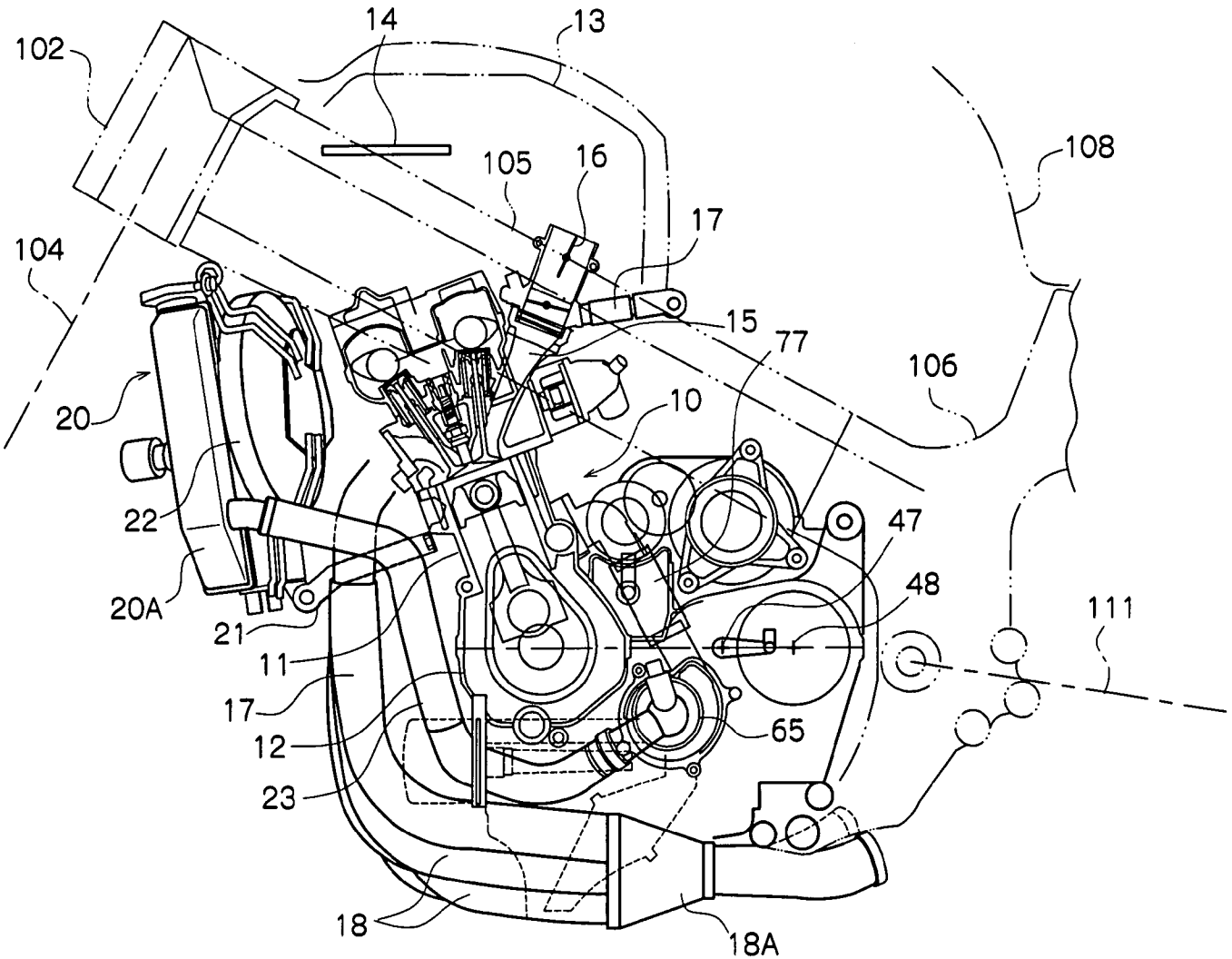
FIG. 2 is a view showing an engine and its surrounding according to the embodiment of the present invention.

For example, four-cycle water-cooling parallel four-cylinder or six-cylinder engine unit 10 is disposed below a fuel tank 108 at a central lower part of the vehicle body of the motorcycle 100 as shown in FIG. 2. In the engine unit 10, a cylinder assembly 11 integrally including a plurality of cylinders is disposed in a width direction of the vehicle body in a state slightly tilted forward at an upper part of a crankcase 12. For example, a four-cylinder engine unit may be adopted in this example, and a parallel multi-cylinder engine of a side cam chain type loaded with each cylinder axis slightly tilted forward from the verticality is adopted. Especially in this case, the cylinder assembly 11 is formed integrally with (a part of) the crankcase 12 by aluminum die cast as will be described later.

Attachment devices such as a fuel feed device, an intake device, an exhaust device and a cooling device, auxiliary machines and the like are attached to or loaded on the engine unit 10. Namely, the air which is cleaned by an air cleaner element 14 is supplied to an intake port 15 from an air cleaner 13 housed in a deep inside of the fuel tank 108. An air amount supplied to the intake port 15 is controlled by a throttle valve 16. A fuel is injected and supplied to the intake port 15 by an injector 17.

Exhaust pipes 18 (four or six exhaust pipes are included in this example) which construct the exhaust device are connected to a front side of the cylinder assembly 11, and a muffler 19 is connected to a downstream side thereof. Each of the exhaust pipes 18 has its upstream end connected to a front part of the cylinder assembly 11, extends downward from a front surface of the engine unit 10, and thereafter, is bent in a substantially L-shape at a lower front part of the crankcase 12, and extends around a lower part of the engine unit 10 to extend rearward. In this case, two or three of the exhaust pipes 18 may be collected in a collecting pipe 18A each on the left and right. In the case of a four-cylinder type, all the four exhaust pipes 18 may be collected, and a muffler 19 can be connected to their downstream sides.

A radiator 20 which constructs the cooling device is disposed below the head pipe 102 and in front of the engine unit 10. A radiator body 20A of the radiator 20 is supported at a proper place of the cylinder assembly 11 or the vehicle body frame 101 (especially the tank rails 105) via a stay 21 or the like, and a fan 22 is mounted to a rear side thereof. The radiator 20 is connected to a water pump which will be described later via an upstream side cooling water pipe 23 and supplies cooled cooling water to the water pump.

Figure 3:
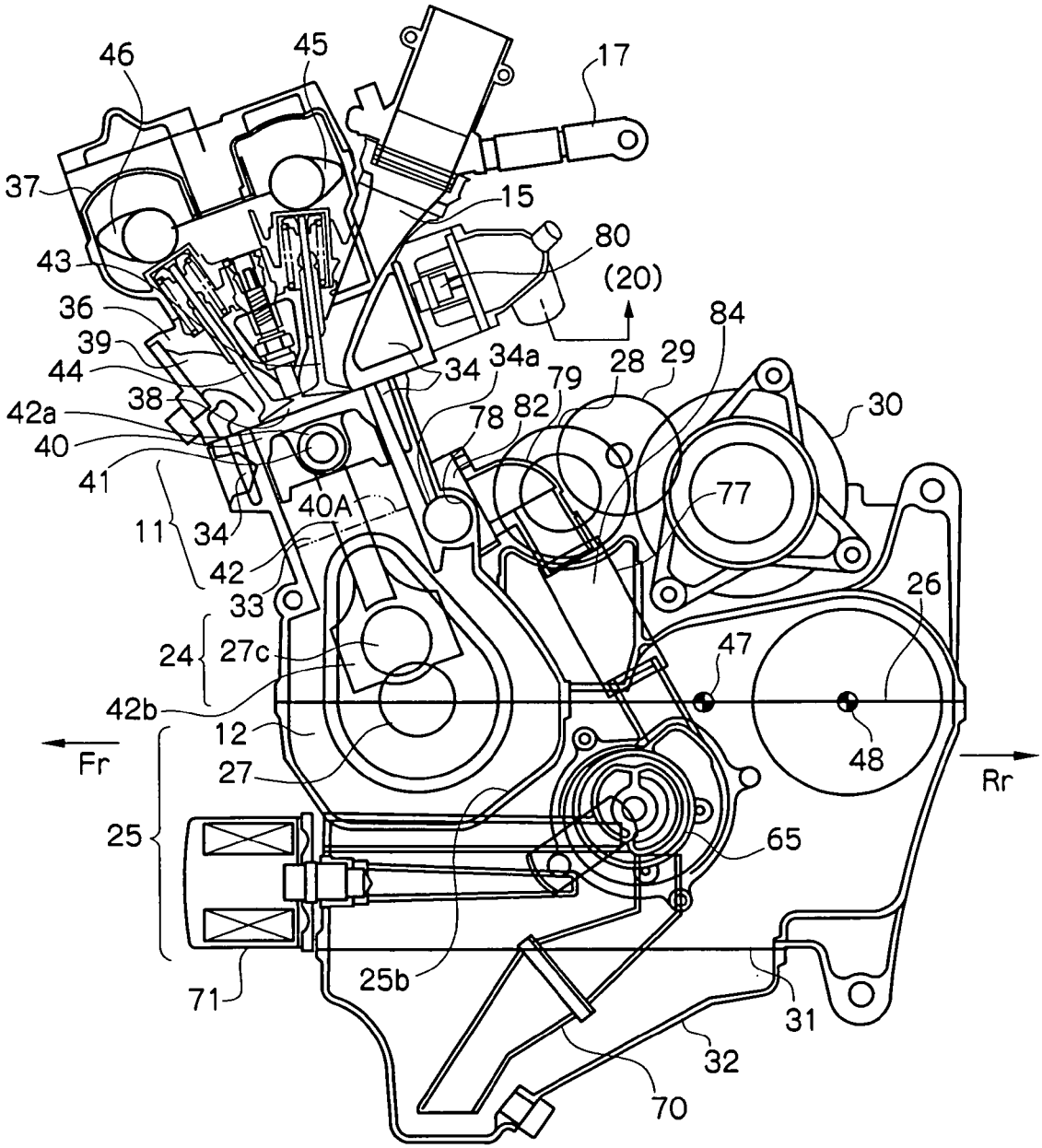
FIG. 3 is a side view of an engine unit according to the embodiment of the present invention.
Figure 4:
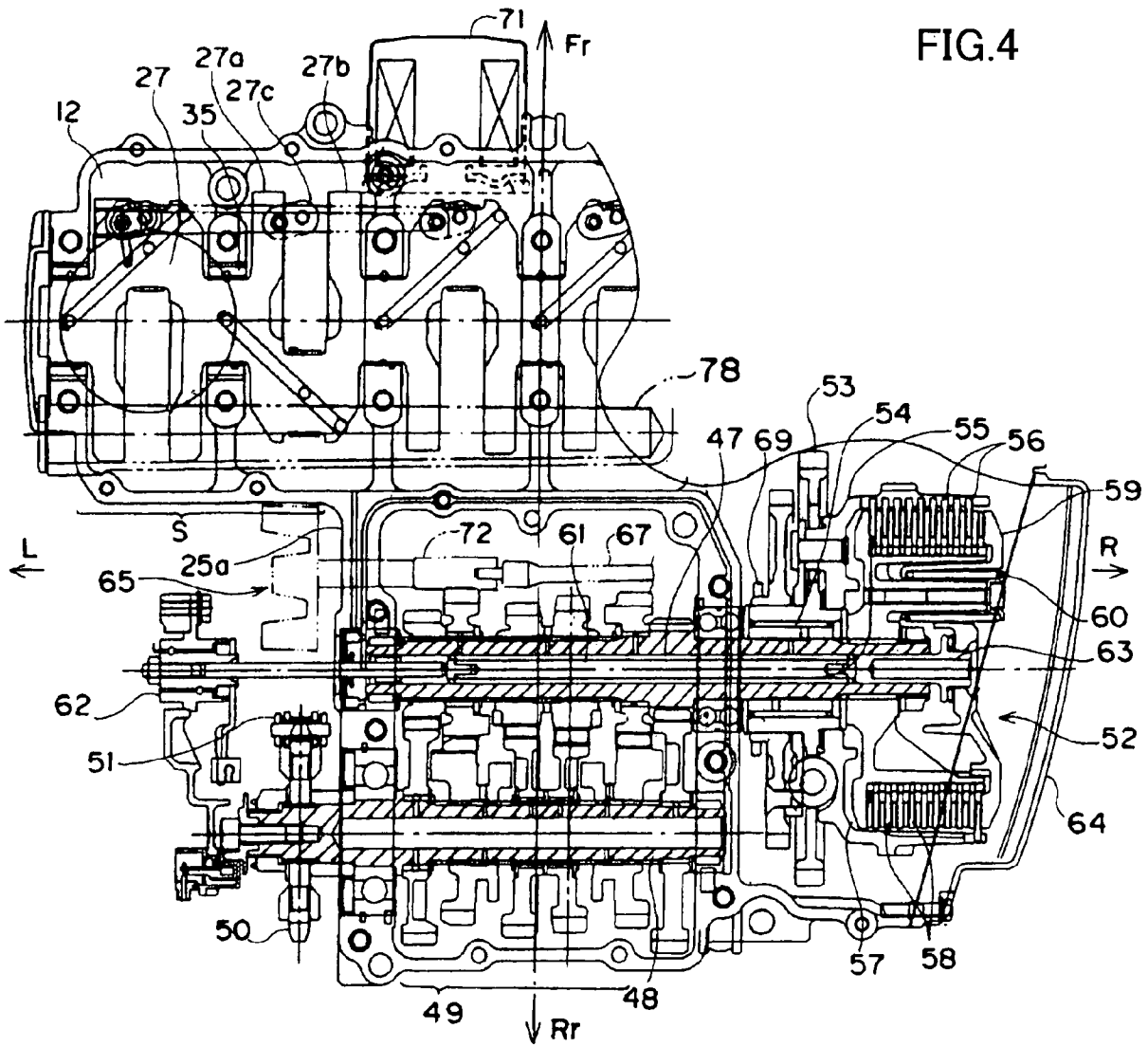
FIG. 4 is a plane view of the engine unit according to the embodiment of the present invention.
Figure 5:
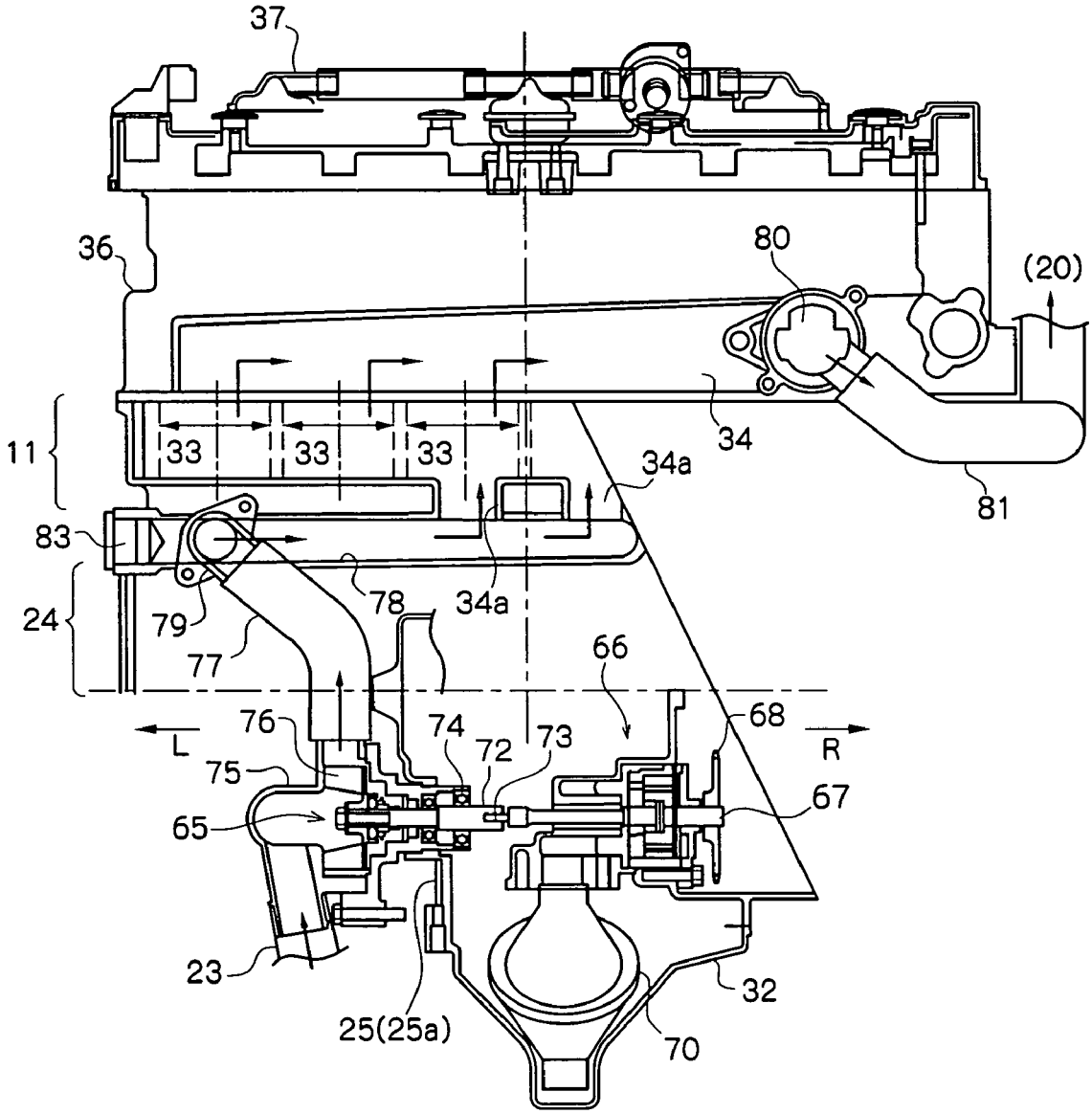
FIG. 5 is a view of a cooling system and its surrounding of the engine unit according to the embodiment of the present invention seen from a rear side.

Next, FIGS. 3 to 5 show an engine unit 10 and its surrounding. FIG. 3 shows a left side view of the engine unit 10, FIG. 4 is a top view thereof, and FIG. 5 is a rear view thereof. In each of the drawings, the arrow Fr shows a front direction of the vehicle and the arrow Rr shows a rear direction of the vehicle. The arrow L shows a left direction of the vehicle and the arrow R shows a right direction of the vehicle.

The crankcase 12 is formed by connecting an upper crankcase 24 and a lower crankcase 25, which are cylinder-block integrated type as described above, respectively in upper and lower half shapes, and each shaft including a crankshaft 27 or the like is supported at a mating surface 26. A rear half part of the crankcase 12 also functions as a mission case, and a transmission gear is housed and disposed therein. A starting motor 28, its idle gear 29, a generator (magnet) 30 and the like are mounted on an upper surface of this mission case part. An oil pan 32 is connected to a lower part of the lower crankcase 25 via a mating surface 31.

A water jacket 34 is formed around each cylinder 33 of the cylinder assembly 11, and the cooling water supplied from the water pump flows inside the water jacket 34 as will be described later. Each cylinder 33 is a so-called plated cylinder, and does not have a cylinder liner (sleeve).

The crankshaft 27 is disposed in a vehicle width direction in the crankcase 12, and is supported by a journal bearing 35 (FIG. 4) which is set at the mating surface 26 of the upper crankcase 24 and the lower crankcase 25. A cylinder head 36 and a cylinder head cover 37 are included at an upper part of the cylinder assembly 11, and a combustion chamber 38 which is formed so as to be matched to a cylinder bore of the cylinder head 33 is included at an undersurface of a cylinder head 36. The aforementioned intake port 15 and an exhaust port 39 which communicate with the combustion chamber 38 are formed in the cylinder head 36.

A piston 40 is slidably fitted into the cylinder bore in each of the cylinders 33, and the piston 40 is connected to a small end part 42*a* of a connecting rod 42 via a piston pin 41. A large end part 42*b* of the connecting rod 42 is connected to a crank pin 27*c* formed between crank webs 27*a* and 27*b* provided at the crankshaft 27 to be paired as shown in FIG. 4. The crankshaft 27 and the piston 40 are thus connected, and thereby, the reciprocating movement of the piston 40 is converted into a rotating movement of the crankshaft 27 via the connecting rod 42, thus obtaining engine output power.

An intake valve 43 which controls the intake port 15 to open and close, and an exhaust valve 44 which controls the exhaust port 39 to open and close are included inside the cylinder head 36, and these valves 43 and 44 are driven by an intake side cam 45 and an exhaust side cam 46.

A countershaft 47 and a driveshaft 48 are disposed at the rear half part of the crankcase 12 in parallel with the crankshaft 27 as shown in FIG. 4. These shafts are supported at the mating surface 26 of the upper crankcase 24 and the lower crankcase 25. A transmission device 49 constructing, for example, a six speed gear transmission mechanism is disposed and constructed between the countershaft 47 and the driveshaft 48, so that the rotation of the countershaft 47 is changed in speed and transmitted to the driveshaft 48 via the transmission device 49. A drive sprocket 50 is mounted at a shaft end of the driveshaft 48, and a chain 51 is wound around a sprocket (not shown) mounted to an axle of the rear wheel 112 and the drive sprocket 50, and thereby a power transmitting route is formed to the rear wheel 112 from the engine unit 10.

A clutch device 52 is mounted to a right side shaft end of the countershaft 47 as shown in FIG. 4. A primary driven gear 53 is rotatably supported at a right side shaft end portion of the counter shaft 47 via a needle bearing 54. Meanwhile, a primary drive gear is provided at the crankshaft 27 and these gears are always meshed with each other. A clutch housing 55 is supported at a right side of the primary driven gear 53 to be integrally rotatable, and a plurality of drive plates 56 displaceable in the axial direction are housed in an inner peripheral part of the clutch housing 55. A clutch sleeve 57 is provided at the countershaft 47 to be integrally rotatable, and a plurality of driven plates 58 displaceable in the axial direction are placed at the clutch sleeve 57 to alternately overlay the drive plates 56.

A pressing disk 59 is placed at an opening at a right end of the clutch housing 55 to close the opening, and this pressing disk 59 is biased leftward in FIG. 4 by an elastic force of a spring 60. A push rod 61 slidable in an axial direction is fitted and inserted in a hollow inner part of the countershaft 47, and this push rod 61 is linked to a clutch release mechanism 62 attached to its left side shaft end portion. A right side shaft end portion of the push rod 61 abuts on a pressing piece 63.

When a clutch lever is gripped, the pressing piece 63 is pressed to move rightward in FIG. 4 via the push rod 61, and the pressing disk 59 displaces rightward against the elastic force of the spring 60. Thereby, frictional engagement between the drive plate 56 and the driven plate 58 is loosened, and the clutch is brought into a disconnected state. The clutch device 52 is covered with a clutch cover 64.

As also shown in FIG. 3, FIG. 5 or the like, a water pump 65 is disposed at a side wall 25*a* of the crankcase 12 (lower crankcase 25) located at a rear position from the crankshaft 27. The side wall 25*a* portion of this lower crankcase 25 has a considerably smaller width dimension as compared with the width of the cylinder bank located at an upper front position, namely, the side wall 25*a* is set back or recessed from the crankshaft end portion to the center of the engine unit 10 by a distance S in the width direction as shown in FIG. 4. The mounting region of the water pump 65 is provided at a rear side from a bottom wall 25*b* portion (see FIG. 3) in the shape along the crank locus, which is near the crank shaft end portion, and is at a slightly lower position.

In this embodiment, the water pump 65 is driven by another shaft (pump shaft driven by the countershaft 47 as will be described later in this example) to which the power is transmitted from the crankshaft 27. Specifically, as shown in FIG. 4, a pump shaft 67 of an oil pump 66 (see FIG. 5) is rotatably disposed between the crankshaft 27 and the countershaft 47. A gear 68 provided at the shaft end of the pump shaft 67 and a gear 69 (FIG. 4) provided at the countershaft 47 are connected via a chain, and the oil pump 66 is driven by the rotation of the countershaft 47.

An oil strainer 70 is fitted in the oil pan 32, so that the oil stored in the oil pan 32 is pumped up by the oil pump 66 via the oil strainer 70. The oil discharged from the oil pump 66 is supplied to each part of the engine needing lubrication through an oil filter 71. The oil filter 71 is mounted to a front part of the crankcase 12 (lower crankcase 25), so that cooling water discharged from the water pump 65 circulates in a cooler core of an oil cooler disposed directly in front of the oil filter 71.

The water pump 65 has a drive shaft 72 disposed coaxially with the pump shaft 67 of the oil pump 66, and end portions of both shafts are connected via a recess and projection fitting structure 73. The drive shaft 72 is rotatably supported at the side wall 25*a* portion of the lower crankcase 25 via a bearing 74. Namely, the drive shaft 72 of the water pump 65 is synchronously rotated with the pump shaft 67 of the oil pump 66. An impeller 76 which rotates in a cavity formed by a cover 75 is fitted to one end of the drive shaft 72, and the cooling water is circulated by the rotation of the impeller 76.

The aforementioned upstream side cooling water pipe 23 has one end connected to the radiator 20, and the other end connected to the water pump 65 (FIG. 5 and the like), namely, it connects the radiator 20 and the water pump 65. A downstream side cooling water pipe 77 which supplies the cooling water to the water jacket 34 of the cylinder assembly 11 is connected to the water pump 65.

Here, as shown in FIG. 3 or FIG. 5, the crankcase 12 (upper crankcase 24) is provided with a cooling water communication passage 78 extending in the direction of the cylinder bank of the cylinder assembly 11. The cooling water is supplied to the water jacket 34 from the cooling water communication passage 78. The cooling water communication passage 78 is adjacently disposed below the water jacket 34 at the rear side of the cylinder bank, and the downstream side cooling water pipe 77 is connected to its intermediate portion.

Figure 6:
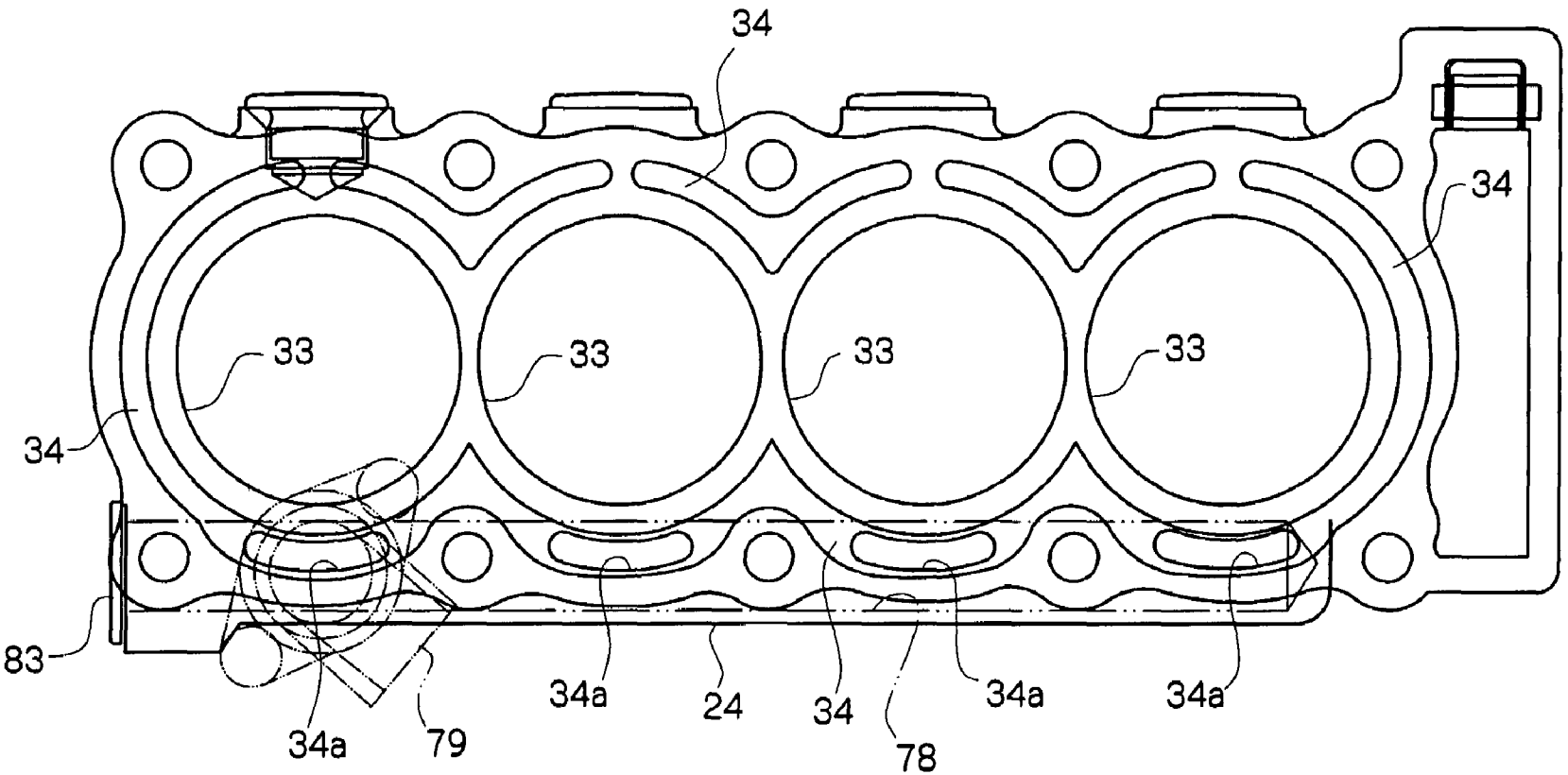
FIG. 6 is a plane view showing a connecting part and its surrounding of a cooling water communication passage according to the embodiment of the present invention.

The cooling water communication passage 78 has, for example, a circular section, and is formed below the water jacket 34 at the intake side, in this example, in the vicinity of the border portion of the cylinder assembly 11 and the upper crankcase 24 by core casting from the lateral direction. As shown in FIG. 3 or FIG. 6, the cooling water communication passage 78 communicates with the connecting portion 34*a* at the lower part of the water jacket 34, namely, is connected to the water jacket 34 of each of the cylinders 33 of the cylinder assembly 11.

The cooling water communication passage 78 has a larger diameter than the sectional width of the water jacket 34, and the outer wall of the crankcase (upper crankcase 24) extending from a lower side of a boss part which forms the cooling water communication passage 78 is offset from an extension line of the water jacket 34 in the cylinder axis direction.

The end portion of the downstream side cooling water pipe 77 at the opposite side from the water pump 65 is connected to the cooling water communication passage 78 via a water inlet 79. A thermostat 80 is fitted to an outlet port of the cooling water of the water jacket 34, and a cooling water pipe 81 connects the thermostat 80 and the radiator 20. Thus, a cooling water system passing through the radiator 20, the upstream side cooling water pipe 23, the water pump 65, the downstream side cooling water pipe 77, the cooling water communication passage 78 and the water jacket 34 is constructed.

As described above, the water pump 65 is provided at the side wall 25*a* of the lower crank case 25 to which the oil pan 32 is mounted, and is disposed at a lower rear position from the crankshaft 27. In this case, along the bottom wall 25*b* of the crankcase 12 around the crankshaft 27 as shown in FIG. 2, the upstream side cooling water pipe 23, the water pump 65 and the downstream side cooling water pipe 77 are arranged in an annular shape, or a U-shape, namely, to surround the bottom wall 25*b* of the crankcase 12. A connecting part which is connected to the cooling water communication passage 78 of the downstream side cooling water pipe 77, namely, a water inlet 79 is disposed at an outer side in the axial direction of the crankshaft (see FIG. 5) from the connecting portion to the water pump 65.

In this case, the water inlet 79 which is mounted to the end portion of the downstream side cooling water pipe 77 is connected to an intermediate portion of the cooling water communication passage 78 with a seat 82 (FIG. 3) provided. Here, the intermediate portion of the cooling water communication passage 78 is an area which is in the end portion outside from the outer edge of the cylinder bore of the outermost cylinder (cylinder at the left end portion in this example) and includes the portion up to the position in the vicinity of a blank cap 83 (see FIG. 5 or FIG. 6) which blocks the cooling water communication passage 78. Namely, this is for the case except the case where the upstream side cooling water pipe 77 is connected to the region with the blank cap 83 from the extending direction of the cooling water communication passage 78 instead of the blank cap 83.

Figure 7:
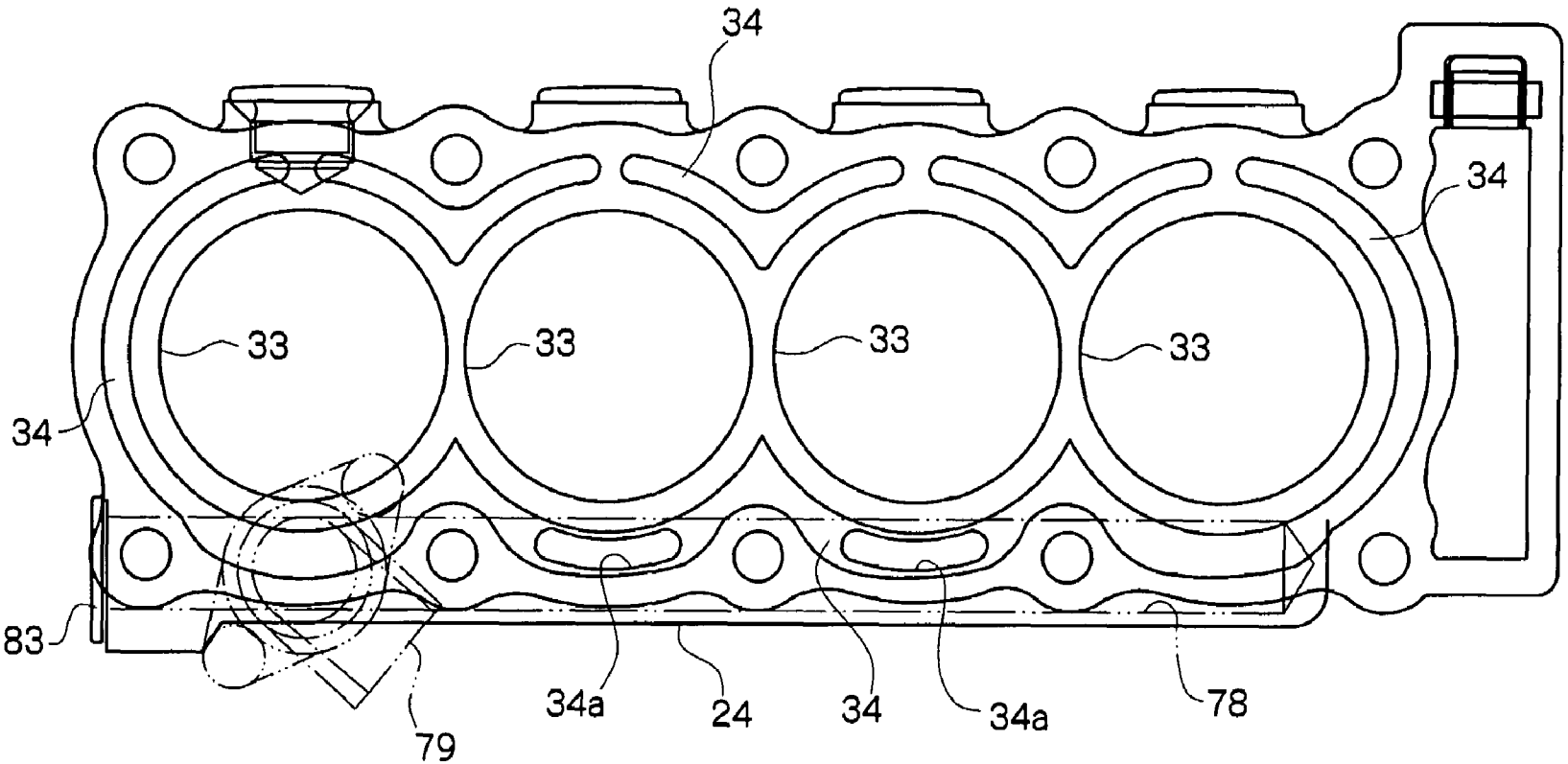
FIG. 7 is a plane view showing a modified example of the connecting part and its surrounding of the cooling water communication passage according to the embodiment of the present invention.

The cooling water communication passage 78 communicates with the water jacket 34 via the connecting part 34*a* as described above, and the connection part 34*a* can be provided at each cylinder bore of each of the cylinders 33 as in the example shown in FIG. 6. In this case, the connecting parts 34*a* are necessarily provided at the inner cylinders except for the outermost cylinder. The connecting part 34*a* does not have to be provided at the outermost cylinder as shown in FIG. 7, namely, it is optionally provided.

As shown in FIG. 3, a lower end surface (connecting part 34*a*) of the water jacket 34 is set to be shorter than the piston stroke, and the position at which the cooling water communication passage 78 is provided is set at a height substantially overlaying the piston position 40A (especially in the vicinity of the crown part) in the piston bottom dead center position.

In the above described case, the upper crank case 24 is provided with a cooling water communication passage 78 part and a breather chamber 84 part. The respective boss portions which form them are disposed between the neighborhoods of the crankshaft 27 and the countershaft 47 in sequence from the front to face an upper surface of the upper crankcase 24 to have their height gradually lowered.

The upper part of the breather chamber 84 is blocked by a separate cover. Further, as shown in FIG. 3 or the like, the starting motor 28 is disposed above the breather chamber 84. The downstream side cooling water pipe 77 is disposed in such a manner as to overlap left sides (in side view) of the starting motor 28 and the breather chamber 84. A magnet 30 is placed in parallel at the rear side of the starting motor 28, and the magnet 30 having a larger outer diameter than the starting motor 28 is disposed behind the starting motor 28, whereby it is possible to dispose the breather chamber 84 of a large capacity below the starting motor 28 of a small diameter in front.

In the cooling structure of the engine according to the present invention with the above described construction, in the engine unit 10 in which the upper crankcase 24 is cast integrally with the cylinders, and the cylinder 33 has an angle from verticality with respect to the mating surface 26 of the crankcase 24, the cooling water communication passage 78 is formed below the water jacket 34 at the intake side by core casting from the lateral direction. In this case, the water pump 65 is provided at the side wall 25*a* of the lower crankcase 25, and the downstream side cooling water pipe 77 connected to the water pump 65 is connected to the intermediate portion of the cooling water communication passage 78. By forming the cooling water communication passage 78 from the lateral direction at the portion which is undercut by the water jacket 34 in casting, the useless thickness of the undercut portion can be removed. The portion varied in thickness in the cylinder 33 is considerably reduced, and hence, unfavorable casting can be remarkably decreased.

In this case, the downstream side cooling water pipe 77 is connected to the water jacket 34 at the intake side, and therefore, the pipe length can be made the shortest, and with this, the excessive cooling water inside the pipe can be decreased. Further, it becomes possible to enhance cooling efficiency at the same time and actually reduce load on the water pump 65.

Further, the width in section in the longitudinal direction of the cooling water communication passage 78 is made larger than the water jacket 34, and the outer wall of the crankcase extending from the lower side of the boss part which forms the cooling water communication passage 78 is offset from the extension line in the direction of the cylinder axis of the water jacket 34, whereby twist rigidity is enhanced, and the useless thickness of the undercut portion can be eliminated.

The lower part of the engine can be disposed and constructed to be compact by arranging the upstream side cooling water pipe 23 and the downstream side cooling water pipe 77 along the bottom wall 25*b* of the crankcase 12 in the substantially annular form. In this case, the connecting portion of the upstream side cooling water pipe 77 to the cooling water communication passage 78 is disposed at the outer side in the direction of the crankshaft axis, namely, located near to the outer side, whereby assemblability at the upper portion of the engine is enhanced. Namely, mounting easiness of the auxiliary machines and the like at the rear side of the upper surface of the upper crankcase 24 is enhanced, for example, mounting of the starting motor 28 is facilitated, or in addition to this, a large capacity of the breather chamber 84 can be secured.

The lower end surface of the water jacket 34 is set to be shorter than the piston stroke, and the cooling water communication passage 78 is set at the height which overlays the piston position 40A, whereby cooling efficiency is enhanced and excessive cooling can be prevented. In this case, the cooling water is distributed to each of the cylinders 33 at a distance up to the lower end of the water jacket 34, and hence, the cooling water is uniformly distributed. Further, there is provided the advantage of making it difficult to emit a slapping sound of the piston 40 and the like.

The cooling water communication passage 78, the breather chamber 84 and the like are disposed between the neighborhoods of the crankshaft 27 and the countershaft 47 in sequence from the front to face the upper surface of the upper crankcase 24 so that their heights are gradually lowered. Thereby, the cylinder rigidity is enhanced without practically increasing the weight and thereby, twist rigidity can be enhanced. Further, the advantage of facilitating the mounting of the accessory machines and the like is provided.

The present embodiment is to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

For example, the example in which the cooling water communication passage 78 is formed by core casting, but when the cooling water communication passage 78 has a small diameter and is extremely long, so-called "drilling work" can be performed in accordance with necessity.

What is claimed is:

1. A cooling structure of an engine, comprising:

a cooling water communication passage provided at a cylinder block-integrated crankcase of an engine with parallel multiple cylinders loaded by being tilted forward, the cooling water communication passage supplying cooling water to a water jacket from a water pump, wherein the cooling water communication passage extends in parallel with a crankshaft so as to divide cooling water into the water jacket corresponds to each cylinder at an opposite side of an exhaust pipe with respect to an axis of the cylinder, the cooling water communication passage is disposed at a substantially same distance from the crankshaft as a piston bottom dead center position which is disposed below a bottom end of the water jacket, a connecting portion provides fluid communication between the cooling water communication passage and the water jacket, the water pump is placed at a side wall of the crankcase located at a rear side from a crankshaft, and a downstream side cooling water pipe through which the cooling water discharged from the water pump is passed is connected to an intermediate portion of the cooling water communication passage.

2. The cooling structure of an engine according to claim 1, wherein the cooling water communication passage is disposed at a rear side of the multiple cylinders and has a larger diameter than a sectional width of the water jacket, and a crankcase outer wall extending from a lower side of a boss part which forms the cooling water communication passage is offset from an extension line in a cylinder axis direction, of the water jacket.

3. The cooling structure of an engine according to claim 2, wherein the water pump is provided at a side wall of a lower crankcase to which an oil pan is mounted, and is located at a lower rear position from the crankshaft, the water pump, the downstream side cooling water pipe connected to the water pump, and an upstream side cooling water pipe connected to the water pump in a substantially annular form to the water pump are arranged in a substantially annular form along a crankcase bottom wall around the crankshaft, and a connecting part of the downstream side cooling water pipe to the cooling water communication passage is disposed at an outer side in the crankshaft direction from the connecting part of the water pump.

4. The cooling structure of an engine according to claim 3, wherein in an upper crankcase of the engine, between neighborhoods of the crankshaft and the countershaft, the cooling water communication passage and a breather chamber portion are provided along an upper surface of the upper crankcase, and a starting motor is placed above the breather chamber portion disposed at a rear from the cooling water communication passage and the starting motor is placed at a substantially same distance as a position of the cooling water communication passage from a mating surface of the crankcase.

5. The cooling structure of an engine according to claim 2, wherein in an upper crankcase of the engine, between neighborhoods of the crankshaft and a countershaft, the cooling water communication passage and a breather chamber portion are provided along an upper surface of the upper crankcase, and a starting motor is placed above the breather chamber portion disposed at a rear from the cooling water communication passage and the starting motor is placed at a substantially same distance as a position of the cooling water communication passage from a mating surface of the crankcase.

6. The cooling structure of an engine according to claim 1, wherein the water pump is provided at a side wall of a lower crankcase to which an oil pan is mounted, and is located at a lower rear position from the crankshaft, the water pump, the downstream side cooling water pipe connected to the water pump, and an upstream side cooling water pipe connected to the water pump in a substantially annular form to the water pump are arranged in a substantially annular form along a crankcase bottom wall around the crankshaft, and a connecting part of the downstream side cooling water pipe connected to the cooling water communication passage is disposed at an outer side in the crankshaft direction from the connecting part of the water pump.

7. The cooling structure of an engine according to claim 6, wherein in an upper crankcase of the engine, between neighborhoods of the crankshaft and a countershaft, the cooling water communication passage and a breather chamber portion are provided along an upper surface of the upper crankcase, and a starting motor is placed above the breather chamber portion disposed at a rear from the cooling water communication passage and the starting motor is placed at a substantially same distance as a position of the cooling water communication passage from a mating surface of the crankcase.

8. The cooling structure of an engine according to claim 1, wherein a lower end surface of the water jacket is set to be shorter than a piston stroke.

9. The cooling structure of an engine according to claim 8, wherein in an upper crankcase of the engine, between neighborhoods of the crankshaft and a countershaft, the cooling water communication passage and a breather chamber portion are provided along an upper surface of the upper crankcase, and a starting motor is placed above the breather chamber portion disposed at a rear from the cooling water communication passage and the starting motor is placed at a substantially same distance as a position of the cooling water communication passage from a mating surface of the crankcase.

10. The cooling structure of an engine according to claim 1, wherein in an upper crankcase of the engine, between neighborhoods of the crankshaft and the countershaft, the cooling water communication passage and a breather chamber portion are provided along an upper surface of the upper crankcase, and a starting motor is placed above a breather chamber portion disposed at a rear from the cooling water communication passage and a starting motor is placed at a substantially same distance as a position of the cooling water communication passage from a mating surface of the crankcase.

11. The cooling structure of an engine according to claim 1, wherein the connecting portion is provided at least at one of the inner cylinders except for the outermost cylinders.

12. The cooling structure of an engine according to claim 1, wherein the connecting portion is provided at each of the cylinders.

13. A cooling structure of an engine with parallel multiple cylinders loaded by being tilted forward, comprising:

a cooling water communication passage extending in a direction parallel with a crankshaft and being provided at a cylinder block-integrated crankcase of the engine;

a water jacket in fluid communication with the cooling water communication passage wherein the water jacket corresponds to each cylinder is supplied with cooling water from the cooling water communication passage, respectively, wherein the cooling water communication passage is disposed below the water jacket at an opposite side of an exhaust pipe with respect to an axis of the cylinder;

a water pump placed at a side wall of the crankcase located at a rear side from a crankshaft; and a downstream side cooling water pipe connected to an intermediate portion of the cooling water communication passage, wherein the down stream side cooling water pipe is in fluid communication with the water pump and the water communication passage wherein cooling water discharged from the water pump is passed through the downstream side cooling water pipe to the water communication passage.

14. The cooling structure of an engine according to claim 13, wherein the water communication passage is disposed at a substantially same distance from a crankshaft as a piston bottom dead center position, wherein the piston bottom dead center position is disposed below a bottom end of the water jacket.

15. The cooling structure of an engine according to claim 13, further comprising a connecting portion providing fluid communication between the cooling water communication passage and the water jacket.

* * * * *